US009861873B1

(12) United States Patent
Davis

(10) Patent No.: US 9,861,873 B1
(45) Date of Patent: Jan. 9, 2018

(54) GOLF TRAINING DEVICE FOR PUTTING

(71) Applicant: Dennis Davis, Martinez, CA (US)

(72) Inventor: Dennis Davis, Martinez, CA (US)

( * ) Notice: Subject to any disclaimer, the term of this patent is extended or adjusted under 35 U.S.C. 154(b) by 0 days.

(21) Appl. No.: 15/261,529

(22) Filed: Sep. 9, 2016

(51) Int. Cl.
*A63B 69/36* (2006.01)

(52) U.S. Cl.
CPC ..... *A63B 69/3644* (2013.01); *A63B 69/3676* (2013.01); *A63B 69/3641* (2013.01); *A63B 2225/09* (2013.01)

(58) Field of Classification Search
CPC ..... A63B 69/3644; A63B 69/3676; A63B 2225/09; A63B 69/3641
USPC ..... 473/257–265, 220
See application file for complete search history.

(56) References Cited

U.S. PATENT DOCUMENTS 2,303,736 A * 12/1942 Hall ..... A63B 69/3676 473/258
3,132,865 A 5/1964 Parker
3,687,459 A 8/1972 Swords
3,791,653 A 2/1974 Yamada
3,806,133 A * 4/1974 Cork ..... A63B 69/3676 473/258
3,868,116 A 2/1975 Ford et al.
4,334,684 A 6/1982 Sterling
4,900,030 A * 2/1990 Houtz ..... A63B 69/3676 473/258
4,919,433 A 4/1990 Millat
5,501,452 A 3/1996 Halvorson
5,527,041 A 6/1996 Terry, III et al.
5,586,945 A * 12/1996 Vonderhaar ..... A63B 69/3676 473/258
5,716,286 A 2/1998 Swan
5,769,732 A * 6/1998 O'Neal ..... A63B 69/3676 473/258
5,776,007 A * 7/1998 Kendall ..... A63B 69/3676 248/176.1
6,450,893 B1 9/2002 Primiano et al.
6,569,030 B1 5/2003 Hamilton
6,572,486 B2 * 6/2003 Sweinhart ..... A63B 69/3644 473/257
6,699,141 B1 3/2004 Florian
6,729,968 B2 * 5/2004 Port ..... A63B 69/3641 473/261
6,869,288 B1 3/2005 Faulkner et al.
6,902,493 B1 6/2005 Rhodes et al.
7,125,342 B2 * 10/2006 Port ..... A63B 69/3641 473/238
7,128,657 B1 10/2006 McCarthy et al.
7,281,986 B2 * 10/2007 Tolson ..... A63B 69/3614 473/257

(Continued)

*Primary Examiner* — Sebastiano Passaniti
(74) *Attorney, Agent, or Firm* — Squire Patton Boggs (US) LLP

(57) ABSTRACT

A training device to improve a golfer's putting ability. The device includes a guide rod supported by legs. An arm rotates about a longitudinal axis of the rod. The arm includes a targeting device (laser), which allows the golfer to align the training device and golf ball with the hole. The golfer establishes club head and ball position relative to the rod suitable to his/her putting stance and putter type. The device is aligned with the hole by moving the rod based on the direction of the light emitted from the laser. When properly aligned movement of the putter along the rod sends the ball towards the hole.

13 Claims, 3 Drawing Sheets

(56) References Cited

U.S. PATENT DOCUMENTS

| | | | | |
|---|---|---|---|---|
| 7,429,222 | B2 | 9/2008 | Tolson | |
| 7,431,661 | B1 | 10/2008 | Cailey | |
| 7,476,158 | B1 | 1/2009 | Cayse | |
| 7,670,231 | B1 | 3/2010 | Greene | |
| 7,708,658 | B2 | 5/2010 | McInerney | |
| 7,727,082 | B2 * | 6/2010 | Larsen | A63B 69/3614 473/221 |
| 8,066,582 | B1 * | 11/2011 | Hauser | A63B 69/3641 473/257 |
| 8,591,349 | B1 | 11/2013 | Jones | |
| 2002/0123385 | A1 | 9/2002 | Primiano et al. | |
| 2002/0165037 | A1 | 11/2002 | Stitz | |
| 2002/0173370 | A1 | 11/2002 | Chapman | |
| 2004/0157675 | A1 | 8/2004 | Youngblood et al. | |
| 2004/0198525 | A1 | 10/2004 | Bender | |
| 2004/0204261 | A1 * | 10/2004 | Port | A63B 69/3641 473/261 |
| 2005/0101400 | A1 | 5/2005 | Dahl | |
| 2005/0197200 | A1 | 9/2005 | Port et al. | |
| 2005/0277482 | A1 * | 12/2005 | Bennett | A63B 69/3641 473/257 |
| 2006/0128492 | A1 | 6/2006 | Hourihan et al. | |
| 2007/0015597 | A1 * | 1/2007 | Bush, III | A63B 24/0003 473/261 |
| 2008/0268976 | A1 | 10/2008 | Tischler | |
| 2008/0287206 | A1 | 11/2008 | Kinney | |
| 2009/0118028 | A1 * | 5/2009 | Tischler, II | A63B 69/3641 473/240 |
| 2009/0143158 | A1 | 6/2009 | Fidge | |
| 2009/0227385 | A1 | 9/2009 | Crealese | |
| 2010/0317448 | A1 | 12/2010 | Leonard | |
| 2011/0224013 | A1 | 9/2011 | Burns | |
| 2013/0331195 | A1 | 12/2013 | Sery | |
| 2013/0337930 | A1 | 12/2013 | Vickers | |
| 2014/0031137 | A1 | 1/2014 | Basile | |
| 2014/0065586 | A1 | 3/2014 | Gabbai | |
| 2017/0189783 | A1 * | 7/2017 | Woodrow | A63B 69/3641 |

* cited by examiner

GOLF TRAINING DEVICE FOR PUTTING

BACKGROUND OF THE INVENTION

Field of the Invention

The present invention relates to devices used to improve putting in the sport of golf.

Description of the State of the Art

Various devices have been proposed over the years for training someone to putt in golf. The devices are often cumbersome to use, not intuitive and do not offer the golfer a simple manner for training muscles and hand/eye coordination so that the face of the putter moves consistently along a desired target line at impact with the golf ball. Examples of putting training devices are described in US2008068976, US20060128492 and U.S. Pat. No. 7,429,222. What is still needed is a golf training device that offers a simple way of training someone on the basic stroke needed to putt a golf ball towards a hole.

SUMMARY OF THE INVENTION

The invention provides a method and apparatus for putting training. The device includes a rod, a targeting or alignment device, legs that support the rod, and an arm that attaches the alignment device to the rod. The device further includes a coupling that couples the arm to the rod and/or leg. The coupling enables the arm to rotate about a longitudinal axis of the rod, which enables a golfer to adjust the alignment device according to his or her putter type and/or putting style.

INCORPORATION BY REFERENCE

All publications and patent applications mentioned in the present specification are herein incorporated by reference to the same extent as if each individual publication or patent application was specifically and individually indicated to be incorporated by reference. To the extent there are any inconsistent usages of words and/or phrases between an incorporated publication or patent and the present specification, these words and/or phrases will have a meaning that is consistent with the manner in which they are used in the present specification.

DETAILED DESCRIPTION

Figure 1A:
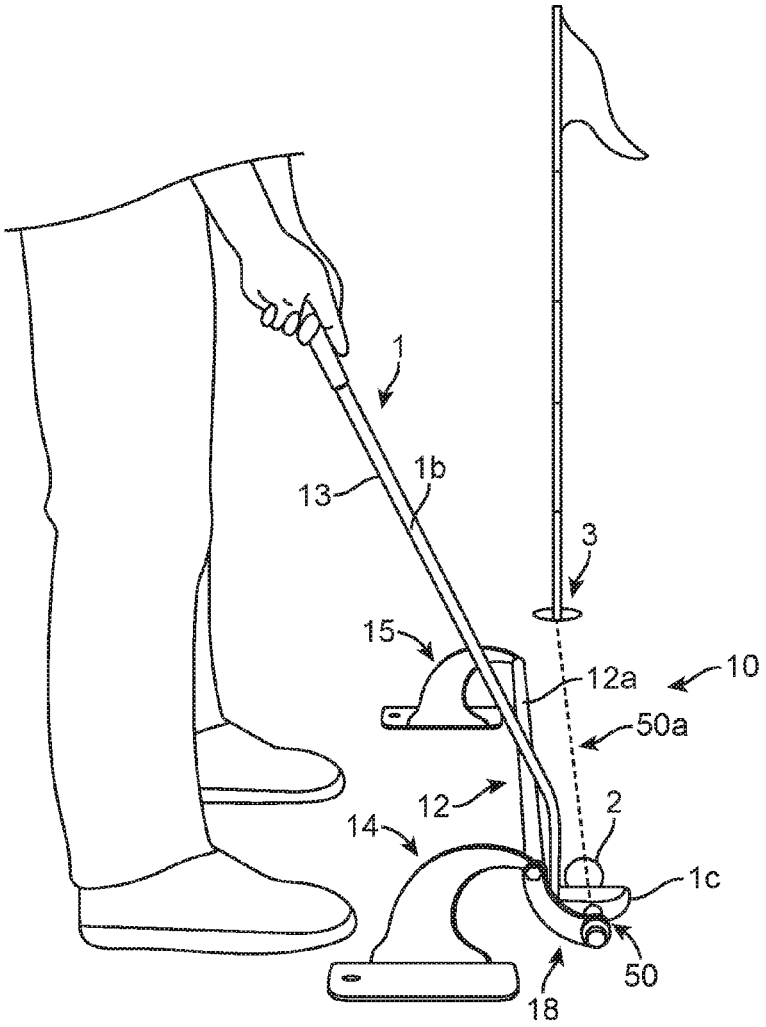
FIG. 1A is a rear perspective view depicting a golfer using a device according to an embodiment of the invention.

In the description like reference numbers appearing in the drawings and description designate corresponding or like elements among the different views.

Figure 1B:
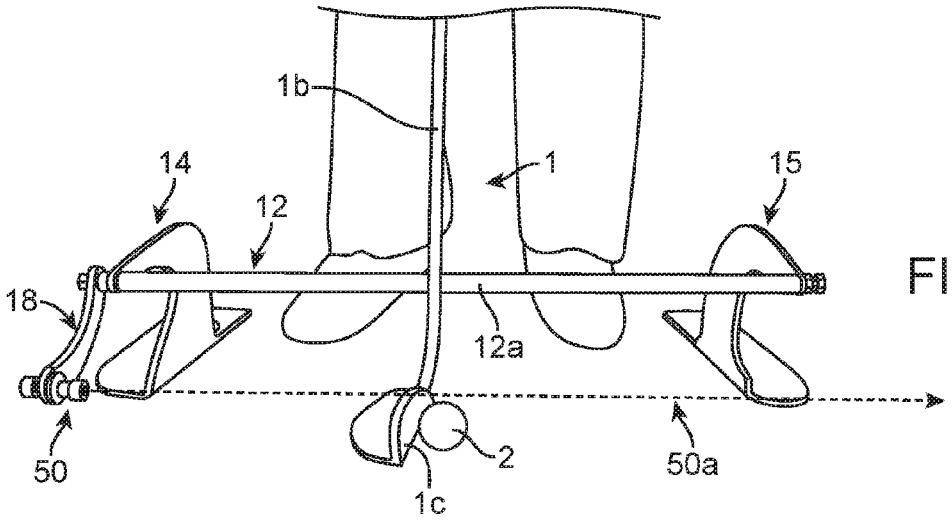
FIG. 1B is a partial side perspective view of FIG. 1A.

Referring to FIGS. 1A and 1B, a golfer is depicted holding a putter 1. The head 1*c* of the putter is positioned behind a golf ball 2. The putter shaft 1*b* is in sliding contact with a surface 12*a* of a rod 12 portion of a training device 10 according to an embodiment. The training device 10 includes a laser 50, first and second legs 14, 15 that support the rod 12. An arm 18 is attached to the rod 12. An alignment device in the form of a laser light, or laser 50 is attached to an end of the arm 18. A laser that can be used for this purpose is a laser sight, e.g., FSM-00QD-140, available from Laser-Lyte, 30 N Alamos Drive, Cottonwood, Ariz. 86326. The arm 18 can rotate about the attachment of the leg 14 and rod 12.

The device 10 helps train a golfer to move the head 1*c* towards the golf hole, thereby striking the golf ball properly so that the ball moves towards the hole 3. The device may be used in the following manner. The device is positioned relative to the golf hole so that laser light 50*a* points at the golf hole 3. When the laser light points at the hole 3 a longitudinal axis A of the rod 12 (see FIG. 2A) extends along a line parallel to the laser light 50*a*. The ball 2 is positioned so that the laser light 50*a* passes over the golf ball. In this orientation the putter 1 swung with the shaft 1*b* sliding over the rod 12 through impact with the ball 2 will cause the ball 2 to move towards the hole 3 (assuming no break in the putt). Additionally, the distance between the light 50*a* and rod 12 is adjusted to account for the golfer's swing and putter type.

Putters come in different varieties and golfers have a variety of putting styles. Some golfers have upright swings (feet closer to ball), while others have flatter swings (feet further away). Additionally, there are blade or tow putters, or central shaft putters. To accommodate different golf swings and/or putter types the device 10 has two features. First, the legs 14, 15 have an overhang L (see FIG. 2B) that accommodates a central shaft-type putter, which may have a portion of the putter head 1*c* to the left of the rod 12 in FIG. 1A (a toe putter, by contrast, has the entire head 1*c* to the right of the rod 12 in FIG. 1A. This is the putter type drawn in FIG. 1A). Second, the arm 18, which holds the laser 50, is rotated to accommodate a ball position relative to the rod 12. For more upright swings the ball 12 is closer to the rod 12 and further away from the rod 12 for flatter swings. Thus, by providing a rotating arm 18 and overhang the setup shown in FIG. 1A (i.e., ball 2 and putter head 1*c* in line with laser light 50*a* and shaft 1*b* slides on rod 12) can be achieved for different putter types and golf swings.

Figure 2A:
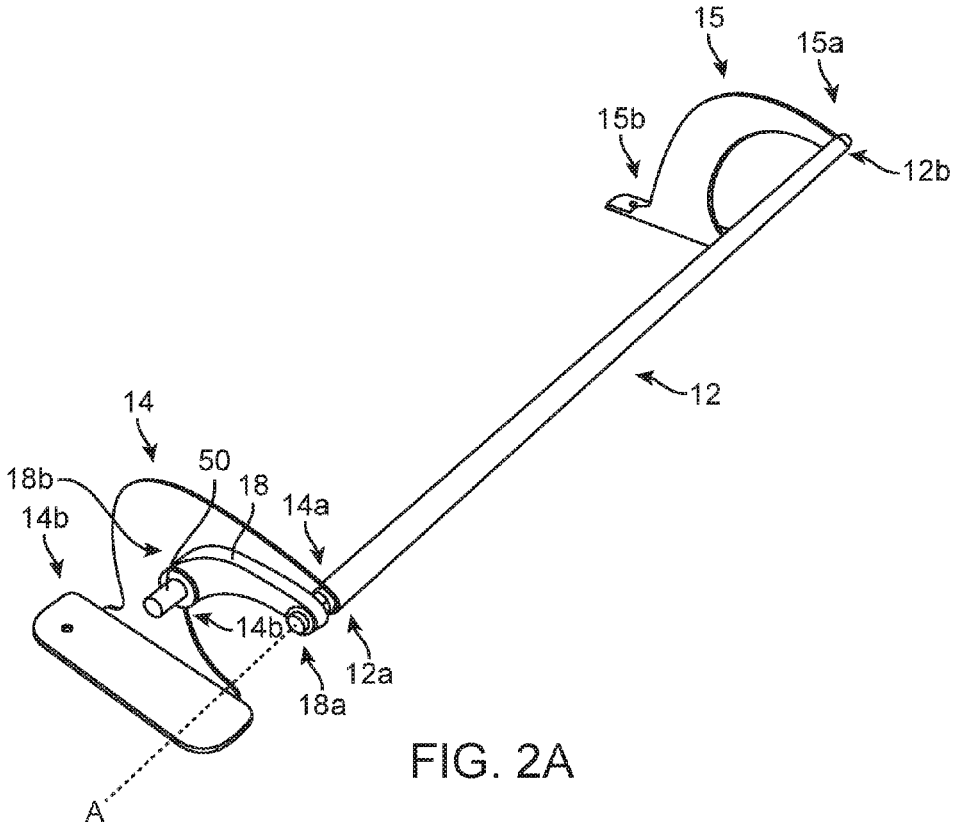
FIG. 2A is a first perspective view of first and second legs and rod portions of the device shown in FIG. 1A.
Figure 2B:
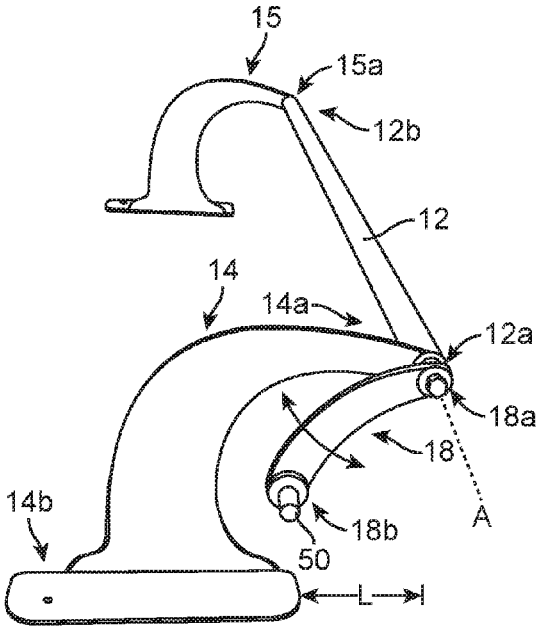
FIG. 2B is a second perspective view of the first and second legs and rod portions of the device shown in FIG. 2A.
Figure 3:
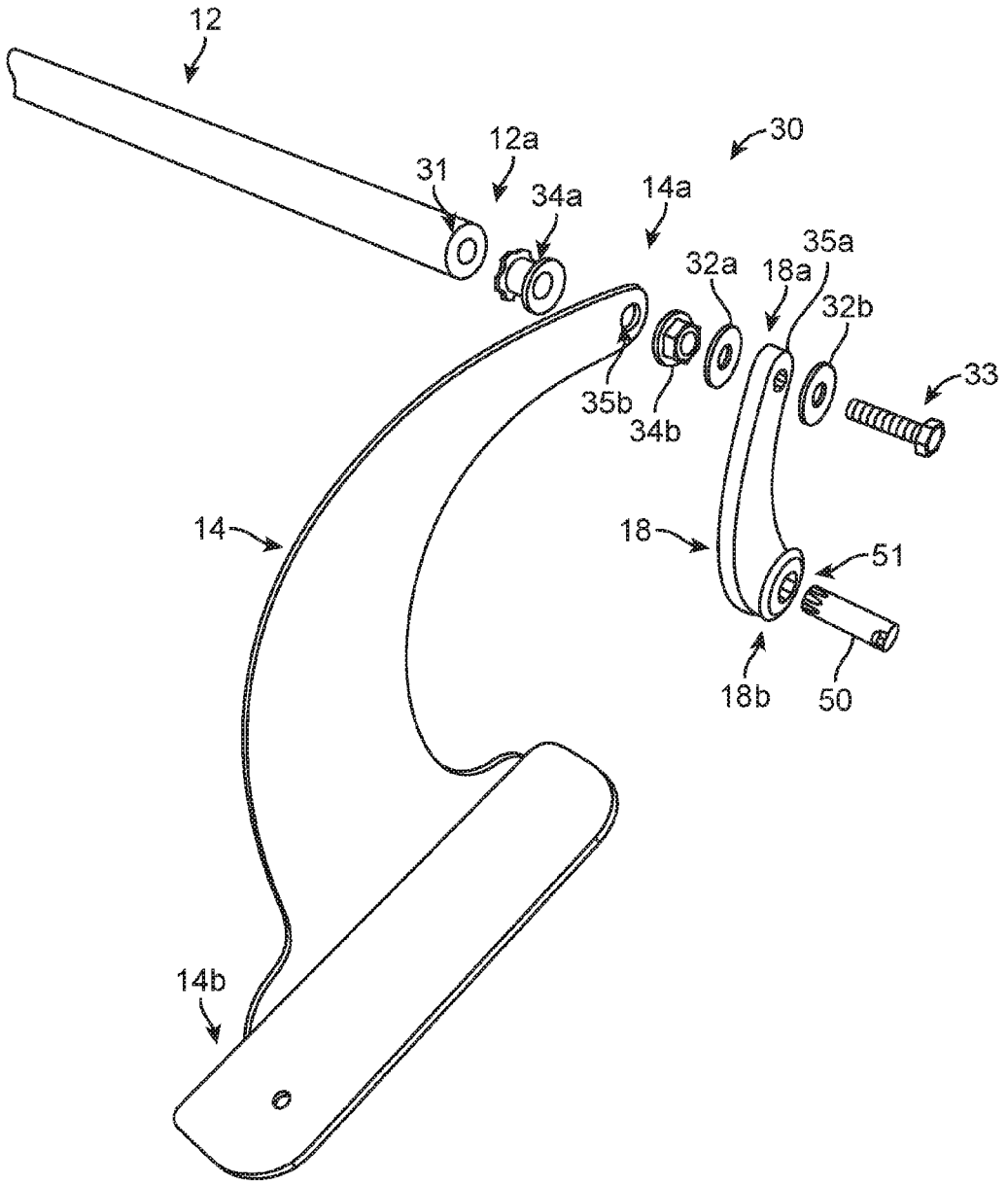
FIG. 3 is an exploded perspective view of a portion of the device shown in FIG. 2B. This view shows a coupling according to a preferred embodiment. Other assemblies are contemplated, as are other embodiments of a coupling according to the invention.

A more detailed description of the device in FIGS. 1A-1B is now provided with reference to FIGS. 2A-2B, and FIG. 3.

FIG. 2A shows the rod 12 supported by first and second legs 14, 15. The legs are mirror images of each other, each one having a base 14*b*, 15*b* and a supporting portion 14*a*, 15*a*. The rod has a first end 12*a* connected to the first leg 14 and a second end 12*b* connected to the second leg 15. The rod 12 and legs 14, 15 are preferably made from a metal material. A polymer sleeve or sheath 13 may be placed over the putter shaft 1*b* so that the metal surface of the rod 12 does not scrape against the putter shaft.

An arm 18 has an attachment end 18*a* and alignment end 18*b*. The arm 18 is attached at its attachment end 18*a* to the first leg supporting portion 14*a* and rod first end 12*a* by a coupling 30 (a detailed view of the coupling 30 is provided in FIG. 3). The coupling 30 enables the arm 18 to rotate about axis A of the rod 12 while restraining all motion in three translational directions and the other two rotational directions (i.e., there is one degree of freedom—rotation about axis A—for arm 18 relative to rod 12). The rod 12 longitudinal axis A passes through attachment end 18*a*. The coupling 30 also connects the first leg 14 to the rod 12 first end 12*a*. The alignment end 18*b* includes a hole 51 for holding the laser 50. Rotation of the arm (as indicated in FIG. 2B) allows the golfer to position the laser 50 at a variety positions relative to the rod 12 to accommodate putter and/or swing types, as explained earlier.

Referring to FIG. 3, according to this particular embodiment, the coupling 30 may include two washers 32*a*, 32*b*, two flat head nuts 34*a*, 34*b*, and a threaded bolt 33 (having a shank and head as shown). Other fastener types are envisioned. The coupling 30 further includes a hole 35*a* formed in the attachment end 18*a* of the arm 18, a hole 35*b* formed in the supporting portion 14*a* of the leg 14 and a bore 31 formed at the first end 12*a* of the rod 12. The assembly order of these pieces is shown in the assembly view of FIG. 3. The shank of the bolt 33 passes through holes 35*a*, 35*b* and threads with mating threads formed in the bore 31 of the first end 12*a*. Washers 32*a* and 32*b* and nuts 34*a*, 34*b* provide a frictional engagement during rotation about axis A. With this assembly the arm 18 can rotate about axis A while also providing a modest degree of frictional resistance to rotation so that the arm can be placed at different locations when the device is adjusted to accommodate different golf swings or putter types. FIGS. 1A and 1B show the arm 18 rotated to a position forward of the rod 12 or base 14*b* and FIG. 2B shows the arm 18 rotated to a position rearward of the rod 12.

As mentioned earlier, legs 14 and 15 are mirror images of each other. The following description of leg 14 applies to leg 15. Leg base 14*b* is a flat plate with a hole to receive a tee for holding the device 10 in place during use. A supporting portion 14*a* extends upwardly from the base 14*b* at a 90 degree angle. The flat plate provides support for the (rod) supporting portion 14*a* in an upstanding manner (see FIG. 1A) sufficient so that when the rod 12 is connected to legs 14, 15 the device is stable. The supporting portion 14*a* is curved so that an upper end of the supporting portion 14*a* (where hole 35*b* is formed) extends at a right angle to the lower end near the base 14*b*. The supporting portion 14*a* is curved and right-angled and provides the overhang L as indicated in FIG. 2B. The overhang L (measured from the forward edge of the plate to the rod 12 outer surface is between 2 and 6 inches) accommodates different putter heads, including those where the shaft is centrally located.

A method for putting a golf ball towards a target includes the steps of using a putter having a shaft, a rod having a rod axis, a laser and an arm connecting the laser to the rod, wherein a coupling between the rod and the arm permits rotation of the laser about the rod axis, adjusting a distance between the golf ball and the rod by rotating the laser about the rod axis, such that a light from the laser passes over the golf ball when the putter is positioned to strike the golf ball and the putter shaft rests on the rod, aligning the laser with the target, and putting the golf ball while the shaft of the putter slides along an outer surface of the rod.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in claims should not be construed to limit the invention to the specific embodiments disclosed in the specification.

What I claim is:

1. A putting device, comprising:

a first leg and a second leg, each leg including a base and a supporting portion;

a rod having a longitudinal axis, including:

a first end connected to the first leg supporting portion, and a second end connected to the second leg supporting portion;

an arm, including:

an arm fastening end proximal the rod first end, an alignment end distal the rod first end, and a laser attached to the alignment end;

a coupling connecting the arm fastening end to the rod first end, such that the rod longitudinal axis passes through the arm fastening end, the arm is fixed in three translational directions and two rotational directions relative to the rod, and the arm rotates about a third rotational direction defined by the longitudinal axis so that a distance between the rod and laser may be adjusted;

wherein the device is for putting training and is capable of supporting a shaft of a putter in sliding contact with the rod, wherein the laser and the rod are oriented so that the direction of light emitted from the laser is generally parallel to the longitudinal axis, wherein the device is configured so that a golf ball may be placed on a ground surface relative to the device, and wherein the light emitted from the laser is enabled to pass over the golf ball prior to a putting stroke.

2. The putting device of claim 1, wherein the coupling further includes:

a fastener having a shank, a bore located at the rod first end and extending at least partially through the rod, an arm hole at the arm fastening end, and a leg hole at the first leg supporting portion, wherein the longitudinal axis passes through the leg hole, the arm hole, and the bore, wherein the shank passes through the leg hole, the arm hole and the bore.

3. The putting device of claim 2, wherein the shank is threaded and the bore has mating threads that engage the shank threads.

4. The putting device of claim 1, wherein the arm is attached to, and rotates about a member having an axis parallel to the longitudinal axis and connected to the rod first end and/or the first leg supporting portion.

5. The putting device of claim 4, wherein the member extends through a leg hole located on the first leg supporting portion.

6. The putting device of claim 4, wherein the member is a fastener attached to the rod first end.

7. The putting device of claim 4, wherein the rod is attached to the first leg supporting portion and the first leg supporting portion is curved to provide an overhang to accommodate different putter head sizes.

8. The putting device of claim 1, wherein the coupling further enables fixing the arm in at least a first and a second position relative to the rod, wherein when in the first position the alignment end enables alignment of the rod with a golf hole and the golf ball using the laser, and wherein when in the second position the alignment end is rearward of the rod so that the alignment end does not interfere with the putting stroke.

9. The putting device of claim 8, wherein the coupling includes a fastener having a head and shank, the fastener connecting the attachment end with the rod, and at least one washer and nut disposed between the head and the rod to provide frictional resistance to rotation of the arm about the longitudinal axis, thereby enabling the arm alignment end to be placed in the at least first and second position relative to the rod.

10. The putting device of claim 1, wherein the first and second legs are separate pieces connected to the respective ends of the rod using fasteners.

11. The putting device of claim 10, wherein at least one of the first leg and the second leg further includes, the supporting portion extends upwards from the base at a right angle, and the base is flat and supports the supporting portion in an upstanding manner.

12. The putting device of claim 11, wherein the first leg supporting portion further includes, a lower end proximal the base and an upper end distal the base, wherein the upper end is located above and forward of the base, to provide an overhang of between 2 inches and 6 inches relative to an end of the base, wherein the overhang permits a putter head located at least partially between the rod and the base to strike a ball without interference from the first leg.

13. The putting device of claim 12, wherein the first leg supporting portion is curved, the lower portion extends upwardly from the base, and the upper portion extends forwardly of the base to provide the overhang of between 2 inches and 6 inches relative to an end of the base.

* * * * *